US005367891A

United States Patent [19]

Furuyama

[11] Patent Number: 5,367,891

[45] Date of Patent: Nov. 29, 1994

[54] FITTING DEVICE FOR ACCESSORY

[75] Inventor: Kazuo Furuyama, Tokyo, Japan

[73] Assignee: Yugen Kaisha Furuyama Shouji, Tokyo, Japan

[21] Appl. No.: 73,440

[22] Filed: Jun. 8, 1993

[30] Foreign Application Priority Data

Jun. 15, 1992 [JP] Japan ..... 4-040814[U]

[51] Int. Cl.[5] ..... A44C 17/02; A44B 1/04

[52] U.S. Cl. ..... 63/29.2; 63/3; 63/2; 24/303; 403/349

[58] Field of Search ..... 24/303, 581, 586; 63/29.2, 3, 4, 29.1, 2; 403/349, DIG. 1

[56] References Cited

U.S. PATENT DOCUMENTS

| | | | |
|---|---|---|---|
| 3,177,546 | 4/1965 | Bey | 24/303 |
| 3,933,011 | 1/1976 | DiGilio et al. | 63/29.1 |
| 4,231,137 | 11/1980 | Fujimoto | 24/303 |
| 4,622,726 | 11/1986 | Nakamura | 24/303 |
| 4,982,581 | 1/1991 | Furuyama | 63/29 |
| 5,008,984 | 4/1991 | Levy | 24/303 |
| 5,050,276 | 9/1991 | Pemberton | 24/303 |
| 5,092,019 | 3/1992 | Levy | 24/303 |
| 5,197,168 | 3/1993 | Levy | 24/303 |

*Primary Examiner*—Michael J. Milano

*Attorney, Agent, or Firm*—Armstrong, Westerman, Hattori, McLeland & Naughton

[57] ABSTRACT

A fitting device for an ornamental accessory is made up of a pair of connecting members each having a cylindrical portion on an end to be fitted together in a rotatable manner relative to each other. One of the connecting members has at its fitting end at least one piece of guide grooves formed in series. The guide groove is made up of a thrust groove which is open into an outside and extends in an axial direction of the connecting member, a rotation groove which bends from an inner end of the thrust groove and extends in a circumferential direction, and a fixing groove which bends from that end of the rotation groove which is away from the thrust groove towards the fitting end. The other of the connecting members has at its fitting end a projection which is thrusted into the thrust groove and moves along the rotation groove. The projection is positioned to correspond to the guide groove. Each of the connecting members has inside its fitting end portion magnet pieces disposed on a plane. The magnet pieces have N pole and S pole arranged to lie alternately in a circumferential direction to form magnetized surfaces facing outwards.

7 Claims, 3 Drawing Sheets

FITTING DEVICE FOR ACCESSORY

BACKGROUND OF THE INVENTION

1. Field of the Invention

The present invention relates to a fitting device or a connecting device for an ornamental accessory or a personal ornament such as a necklace, a pendant, or the like and, in particular, to a fitting device to be used in detachably fitting or connecting both ends of the above-described ornamental accessory which is formed in the form of a chain.

2. Description of Related Art

As a fitting device for connecting both ends of an ornamental accessory such as a necklace, a pendant, or the like which is to be put to actual use in the form of an endless chain, there have hitherto been disclosed many ideas. There are widely used such a construction in which a hook is engaged into a ring or one in which a fitting device provided on both ends is engaged by means of a spring force.

In wearing the above-described ornamental accessory, the handling for connection or engagement of split ends thereof should preferably be simple seeing that such connecting or engaging operation must be performed at the rear portion of the wearer's neck with his or her hands wound therearound. The above-described fitting device made up of a hook and a ring is relatively simple in connecting and disconnecting operation, but has a disadvantage in that the engagement is likely to be released or come out of engagement. The fitting device to be connected by means of a spring force, on the other hand, is relatively simple and handy, but it is accompanied with a trouble of having to release the spring force at the time of disengagement thereof.

SUMMARY OF THE INVENTION

In view of the foregoing disadvantages, the present invention has an object of providing such a fitting device for an ornamental accessory as is easy in engagement and disengagement at the rear of the wearer's neck and is not likely to be easily come out of engagement during wearing.

According to the present invention, the foregoing and other objects are attained by a fitting device for an ornamental accessory comprising: a pair of connecting members -each having a cylindrical portion on an end to be fitted together in a rotatable manner relative to each other; one of the connecting members having at its fitting end at least one piece of guide groove, the guide groove comprising a thrust groove which is open into an outside and extends in an axial direction of the connecting member, a rotation groove which bends from an inner end of the thrust groove and extends in a circumferential direction, and a fixing groove which bends from that end of the rotation groove which is away from the thrust groove towards the fitting end; the other of the connecting members having at its fitting end a projection which is thrusted into the thrust groove and moves along the guide groove, the projection being positioned to correspond to the guide groove; each of the connecting members having inside its fitting end portion magnet pieces disposed on a plane, the magnet pieces having N pole and S pole arranged to lie alternately in a circumferential direction, thereby forming a magnetized surface facing outwards.

According to the above-described fitting device, the cylindrical portions on each end to be fitted together are oppositely placed relative to each other and the projection on the other of the connecting members is aligned to and thrusted into the open end of the thrust groove.

The magnet pieces on the magnetized surfaces are arranged such that, at the time of mounting both connecting members together, the opposite poles in the fitting end portions of both connecting members face each other. Therefore, when both connecting members are mounted together in this condition, the magnet pieces on both connecting members attract each other by causing the opposite poles of the magnets to face each other. As a consequence, the mounting operation becomes easy. The connecting members are then rotated relative to each other to move the projection along the guide groove. In one preferred embodiment, when the projection is moved about 90°, the magnet pieces will be in a position in which the same magnetic poles face each other. It follows that the connecting members are urged against each other through the repelling forces of the magnet pieces and that, at the end of the guide grooves, the projection will be in a condition of being fixed into the fixing groove. Since the connecting members are connected together through these engaging movements, an external force, if any, to work on the connecting members mainly operates to separate the connecting members apart to release their engagement. However, because the connecting force between the fixing groove and the projection also operates to separate the connecting members apart, the engagement will not be loosened or released by an external force.

When the connecting members are to be released from the above-described engaged or fitted condition, the connecting members are first operated, in an opposite manner to the above, to become closer to each other, thereby releasing the engagement of the projection out of the fixing groove. Then, the connecting members are rotated relative to each other in the opposite direction to the above, and at the end of the guide groove the projection is pulled out of the thrust groove. It follows that the fitting device of the present invention can be used without failure by a simple operation. Namely, at the time of engagement, the connecting members may be pushed with the projection being in alignment with the guide grooves and rotated relative to each other and, at the time of disengagement, the connecting members may be pushed towards each other, rotated relative to each other and pulled out.

BRIEF DESCRIPTION OF THE DRAWINGS

The above and other objects and the attendant advantages will become readily apparent by reference to the following detailed description when considered in conjunction with the accompanying drawings wherein.

DESCRIPTION OF A PREFERRED EMBODIMENT

Numeral 1*a*, 1*b* denote connecting members which are to be mounted on both ends of an ornamental accessory such as a pendant, a necklace or the like and are fitted or engaged together in wearing the ornamental accessory. These connecting members 1*a*, 1*b* are called a fitting device. The fitting or connecting ends 2*a*, 2*b* of these connecting members 1*a*, 1*b* are both formed into cylinders in shape so as to be fitted or engaged together in a rotatable manner. In the illustrated example, the entire connecting members are formed into cylinders, but their shapes may be arbitrarily made into, squares, polygons or the like. At least the fitting portions, however, shall in particular be made into a cylindrical form to allow for their rotation relative to each other.

On a cylindrical fitting end 2*a* of one 1*a* of the connecting members 1*a*, 1*b*, there are formed the following guide grooves 3, i.e.: thrusting grooves 3*a*, 3*a* which are formed at the fitting end so as to be in communication with the outside and which extend in an axial direction of the connecting member 1*a*; rotation grooves 3*b*, 3*b* which extend in an angularly bent manner in a circumferential direction from axially internal ends (i.e., ends away from the fitting end) of the respective thrusting grooves 3*a*, 3*a*; and fixing grooves 3*c*, 3*c* which extend in an angularly bent manner in the axial direction towards the fitting end 2*a* such that an appropriate space is left to the fitting end 2*a*. In the illustrated example, the guide grooves are so formed that two pieces each are disposed in a diametrically opposite manner. However, the number of the guide grooves may be arbitrarily decided to be only one, or two or more.

On a cylindrical fitting end 2*b* of the other 1*b* of the connecting members 1*a*, 1*b*, there are provided projections 4, 4 which are of the shape to allow them to enter or thrust from the open ends of the thrust grooves 3*a*, 3*a* and then to move into the rotation grooves 3*b*, 3*b* and further into the fixing grooves 3*c*, 3*c*. In the illustrated example, there are provided the same number, i.e., two pieces each in positions which correspond to the position of the guide grooves 3, 3.

Figure 1:
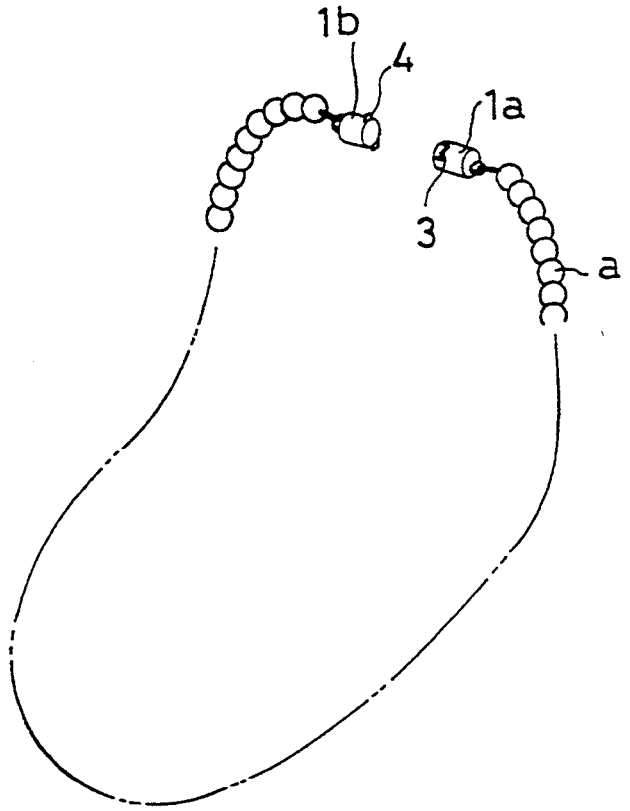
FIG. 1 is a perspective view of a necklace as an example in which the fitting device of the present invention is used.
Figure 2:
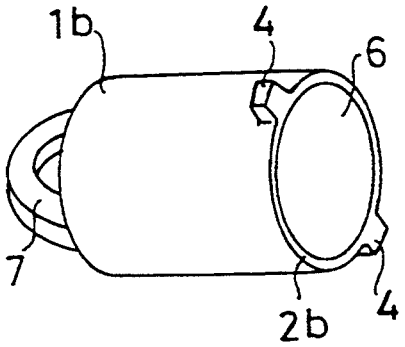
FIGS. 2(*a*) and 2(*b*) are perspective views showing the respective connecting members.
Figure 2:
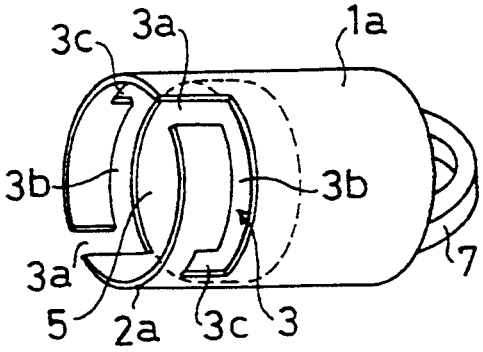
Figure 3:
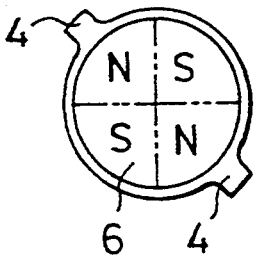
FIGS. 3(*a*), 3(*b*) and 3(*c*) are plan views showing the fitting end portions of the respective connecting members.
Figure 3:
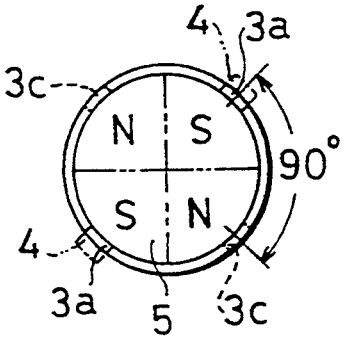
Figure 3:
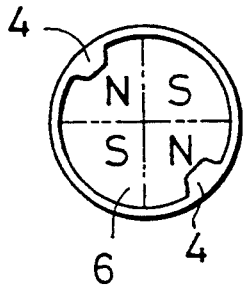
Figure 4:
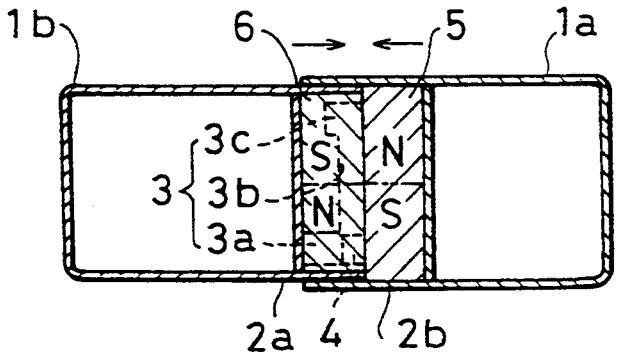
FIG. 4 is a sectional side view showing a condition in which the connecting members are put together.
Figure 5:
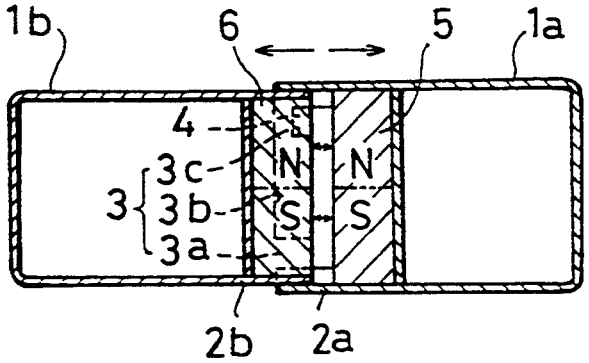
FIG. 5 is a sectional side view showing a condition in which the connecting members are fitted or engaged together.

In FIGS. 2 through 6 there are shown an example in which the projections 4, 4 are provided in a projecting manner on an external periphery of the cylindrical fitting end 2*b* and in which the connecting member 1*b* is fitted into the opposing connecting member 1*a*. However, as a modified example, the following construction as shown in FIG. 3(*c*) may be employed. Namely, the projections 4, 4 are formed in a projecting manner on an internal surface of the cylindrical fitting end 2*b*, and the connecting member 1*b* is fitted onto an external surface of the other 1*a* of the connecting members 1*a*, 1*b* so as to detachably engage the projections 4, 4 with the guide grooves 3, 3.

Furthermore, as shown in FIG. 3(*b*), the projecting length of the projections 4, 4 may be made relatively large so that, when they are engaged into the guide grooves 3, 3, the projections 4, 4 may slightly project out of the guide grooves 3, 3 as shown by imaginary lines in FIG. 3(*a*). In such an arrangement, the projecting portions can advantageously be recognized palpably at the time of engagement or disengagement of the fitting device. This kind of construction of further projecting the projections 4, 4 outside the guide grooves 3, 3 can again be arbitrarily employed where necessary.

Figure 6:
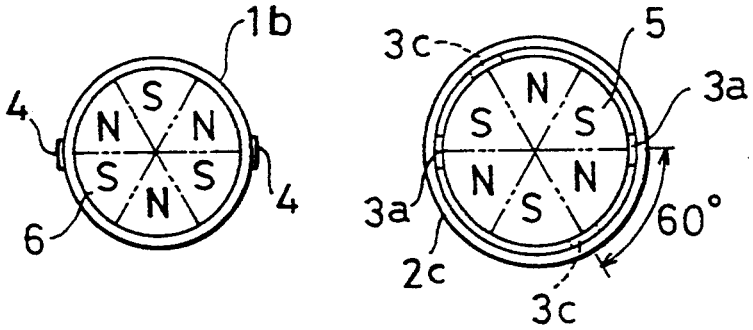
FIGS. 6(*a*) and 6(*b*) are plan views showing modified embodiment of the fitting end portions of the connecting members.

In the illustrated examples, the guide grooves 3, 3 are made such that they are exposed to the outside of the peripheral wall of the connecting member 1*a*. However, depending on the thickness of the cylindrical fitting portion 2*a* of the connecting member 1*a*, the guide grooves 3, 3 may be formed into dented grooves on the internal surface thereof. Or else, in case the wall thickness of the connecting member 1*a* is small, a covering member 2*c* is put on top of the connecting member 1*a* as shown in FIG. 6(*a*) to thereby keep the projections 4, 4 out of sight. Numerals 5, 6 denote plate-like magnet pieces to be respectively fixed to the fitting end portions 2*a*, 2*b* of the connecting members 1*a*, 1*b*. As shown in FIG. 3, magnetic poles of N and S are disposed on two surfaces which face each other when engaged together, in the same alternate manner in the peripheral direction so that one of the surfaces magnetically attract the other. In one 1*a* of the connecting members 1*a*, 1*b* the magnet pieces 5 are fixed inside the cylindrical fitting end portion 2*a* below the portion in which the guide grooves 3, 3 are formed. In the other 1*b* of the connecting members 1*a*, 1*b* the magnet pieces 6 are fixed near the end portion of the cylindrical fitting portion 2*b*. Both magnet pieces 5, 6 are thus arranged to face each other at their respective magnetized surfaces.

Figure 7:
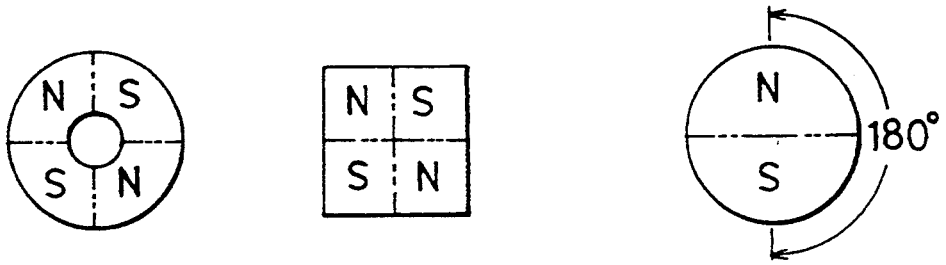
FIGS. 7(*a*), 7(*b*) and 7(*c*) are plan views showing modified embodiments of magnet pieces.

In the example of FIG. 3 the magnet pieces 5, 6 are arranged such that the magnetic poles of N and S are arranged in two sets in the peripheral direction. However, the arrangement needs not be limited to such a one, but may also be arranged, as shown in FIG. 6, such that one set made up of the N pole and the S pole is disposed in three sets. Or else, as a minimum requirement, as shown in FIG. 7(*c*), the N pole and the S pole may form only a single set; the number of combination is thus arbitrary. The magnet pieces need not be limited to a circle in shape, but may be made into a shape of dough nut as shown in FIG. 7(*a*) or a square as shown in FIG. 7(*b*) or an unillustrated polygon.

As described above, depending on the number of sets of magnetically attracting N pole and S pole, the circumferential lengths of the rotation grooves 3*b* in the engaging guide grooves 3 may vary. Namely, when the magnetically attracting sets of N pole and S pole are two as shown in FIG. 3, the amount of rotation about the center of rotation requires an arcuate length equivalent to 90°. In the three sets of arrangement as shown in FIG. 6, the arcuate length equivalent to 60° is required. In one set of arrangement as shown in FIG. 7(*c*), the arcuate length of rotation of 180° is required. In such a case, since it will be impossible to provide two pieces of guide grooves in the peripheral direction on the same level as seen in the axial direction, shorter guide grooves 3 may be formed within a range available in the peripheral direction. Even with such an arrangement sufficient repelling forces due to opposing magnetic poles at the time of engagement can be secured. Further, two pieces of guide grooves 3, 3 may be formed in a manner staggered in the axial direction and two pieces of projecting portions 4, 4 to be introduced or thrusted into the guide grooves 3, 3 can accordingly be deviated in position in the axial direction. Thus, two pieces of guide grooves 3, 3 corresponding to rotation amount of 180° can be formed in the peripheral direction. The magnet pieces of N pole and S pole may be arranged alternately in the circumferential direction in an arbitrary method by an arbitrary means.

According to the present invention, when a pair of connecting members are fitted together, magnetically opposite poles of magnet pieces are caused to face each other such that their attracting forces are advantageously utilized to facilitate the engagement. After one of them has been thrusted or engaged into the other, the projections and the guiding grooves are automatically brought into engagement due to the repelling forces of the opposite magnetic poles on the magnetic attracting surfaces. It follows that the engagement and disengagement of the connecting members can easily be made simply by the thrusting (or inserting) and the rotating operations. Fitting portions are normally disengaged by external forces of repelling or separating them apart. In this invention, on the other hand, the fitting portions are caused to be connected or fixed together by means of the operating forces to magnetically repel or separate them apart. Therefore, there is no possibility that the engagement is released by an external force while the ornamental accessory is in use. This invention has an advantage that a safe use of the accessory can be secured and that a simple and cheap construction thereof becomes possible.

It is readily apparent that the above-described fitting device meets all of the objects mentioned above and has the advantage of wide commercial utility. It should be understood that the specific form of the invention hereinabove described is intended to be representative only, as certain modifications within the scope of these teaching will be apparent to those skilled in the art.

Accordingly, reference should be made to the following claims in determining the full scope of the invention.

What is claimed is:

1. A fitting device for an ornamental accessory comprising:

a pair of connecting members each having a cylindrical portion on an end to be fitted together in a rotatable manner relative to each other;

one of said connecting members having at its fitting end at least one piece of guide groove, said guide groove comprising a thrust groove which is open into an outside and extends in an axial direction of said connecting member, a rotation groove which bends from an inner end of said thrust groove and extends in a circumferential direction, and a fixing groove which bends from that end of said rotation groove which is away from said thrust groove towards said fitting end;

the other of said connecting members having at its fitting end a projection which is thrusted into said thrust groove and moves along said rotation groove, said projection being positioned to correspond to said guide groove;

each of said connecting members having inside its fitting end portion magnet pieces disposed on a plane, said magnet pieces having N pole and S pole arranged to lie alternately in a circumferential direction, thereby forming a magnetized surface facing outwards.

2. A fitting device according to claim 1, wherein said guide groove and said projection are respectively provided in a pair which are in diametrically opposite positions.

3. A fitting device according to claim 1, wherein said projection is formed on an external periphery of said fitting end.

4. A fitting device according to claim 1, wherein said projection is formed on an internal periphery of said fitting end.

5. A fitting device according to claim 1, wherein when said projection of the other of said connecting members is disposed within said thrust groove of said one of said connecting members, said poles of said connecting members impart an attractive force therebetween.

6. A fitting device according to claim 5, wherein when said projection of the other of said connecting members is disposed within said fixing groove of said one of said connecting members, said poles of said connecting members impart an opposing force therebetween.

7. A fitting device for an ornamental accessory comprising:

a pair of connecting members each having a cylindrical portion on an end to be fitted together in a rotatable manner relative to each other;

one of said connecting members having at its fitting end at least one piece of guide groove, said guide groove comprising a thrust groove which is open into an outside and extends in an axial direction of said connecting member, a rotation groove which bends from an inner end of said thrust groove and extends in a circumferential direction, and a fixing groove which bends from that end of said rotation groove which is away from said thrust groove towards said fitting end;

the other of said connecting members having at its fitting end a projection which is thrusted into said thrust groove and moves along said rotation groove, said projection being positioned to correspond to said guide groove;

each of said connecting members having inside its fitting end portion magnet pieces disposed on a plane, said magnet pieces having N pole and S pole arranged to lie alternately in a circumferential direction, thereby forming a magnetized surface facing outwards;

wherein said projection projects out of said guide groove, said fitting device further comprising a covering member which is disposed over the external periphery of said connecting member to keep said projection out of sight.

* * * * *